US006508926B1

(12) United States Patent
Falkner et al.

(10) Patent No.: US 6,508,926 B1
(45) Date of Patent: Jan. 21, 2003

(54) METHOD AND DEVICE FOR PARTIAL ELECTROCHEMICAL TREATMENT OF BAR-SHAPED OBJECTS

(75) Inventors: Johann Falkner, Schnaittach (DE); Rudolf Kauper, Schwanstetten (DE); Manfred Krepelka, Berlin (DE); Thomas Lummer, Greding (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 09/763,417

(22) PCT Filed: Jul. 23, 1999

(86) PCT No.: PCT/DE99/02311

§ 371 (c)(1),
(2), (4) Date: Feb. 21, 2001

(87) PCT Pub. No.: WO00/11245

PCT Pub. Date: Mar. 2, 2000

(30) Foreign Application Priority Data

Aug. 21, 1998 (DE) ..... 198 37 973

(51) Int. Cl.[7] ..... C25D 5/02; C25D 5/00; C25D 17/00

(52) U.S. Cl. ..... 205/118; 205/136; 205/137; 204/198; 204/202; 204/224 R; 204/225; 204/226

(58) Field of Search ..... 205/118, 136, 205/137, 149, 151; 204/198, 224 R, 225, 226

(56) References Cited

U.S. PATENT DOCUMENTS 4,668,369 A * 5/1987 King ..... 204/227
6,071,400 A * 6/2000 Schroder et al. ..... 204/198
6,168,691 B1 * 1/2001 Kauper et al. ..... 204/224 R

FOREIGN PATENT DOCUMENTS

DE AS 11 03 103 11/1958
DE 197 22 983 2/1998

* cited by examiner

*Primary Examiner*—Nam Nguyen
*Assistant Examiner*—Erica Smith-Hicks
(74) *Attorney, Agent, or Firm*—Paul & Paul

(57) ABSTRACT

In a device, rod-shaped objects 10 (rods of various length and diameter) are electrochemically partially processed in dip plants (galvanized, pickled). Stationary tubular electrodes 30, into which the rods 10 are centrically entered, are provided in the plating tank of the plant. The surfaces to be plated are each axially limited by an adjustable membrane carrier 26, in which elastic shielding membranes 9 for delimiting the field lines are arranged. The membranes 9 are held by membrane holders 5. The membrane holders 5 are arranged in a cage where they are free to move radially and are provided with inner centering springs 7 and with outer centering springs 19 so that the membrane holder 5 and the membranes 9 are held in such a way as to be self-centering.

11 Claims, 5 Drawing Sheets

METHOD AND DEVICE FOR PARTIAL ELECTROCHEMICAL TREATMENT OF BAR-SHAPED OBJECTS

The invention relates to a device as well as to a method for the partial processing, e.g., galvaniz galvanizing, electrochemical pickling or electrochemical cleaning of bar-shaped objects in dip plants, namely in galvanizing lines, pickle lines and cleaning lines.

In the following description, the objects to be processed will be referred to as the rod. Devices for electrochemical pickling, galvanizing and electrochemical cleaning of long stretched-out cylinders, in particular of round rods, are well known. At one end or at both, these rods may be tapered and/or threaded. One such example is the cylinder in shock absorbers in vehicles. The invention however is not limited to the processing of round rods. It is also suited for the treatment of rods having another section.

The electrochemical processing of the rods serves for example to improve the wear and corrosion resistance properties of shock absorber cylinders. To this purpose, the rods are electrolytically plated with hard-chromium at only such surfaces which are subjected to load during operation. The other places of the rods are intended to remain uncoated or to be partially provided with a thin layer of flash chrome for temporarily protecting their surface. In order to improve the adherence of the chromium layer, the surface is electrochemically pickled first. Insoluble electrodes are preferably employed for either step in the process. Between the various steps of the treatment, the rods are cleaned in galvanizing lines. A conveying facility brings the rods from one processing station to the other.

To partially process the rods in their central region, the ends have to be masked, i.e., shielded in such a way that no metal or, as a temporary protection flash chromium, can be deposited onto these dimensionally accurately beforehand defined areas. The boundaries between the area of deposition and the areas not to be coated generally have close tolerances. On certain shock absorber cylinders, the uncoated area must verge into the coated area e.g. within a range of ±1 millimeter only. The thickness of the coating to be deposited must be uniform up to this boundary. Edge effects, i.e., an increase or decrease of the coating's thickness on its boundaries must be avoided. The goal of such an accurate coating is to eliminate the need for subsequent polishing.

In the plants of the art, the rods are attached to racks where they are processed, the proper racks being attached to movable flight bars. The racks are provided with individual masks in such a manner that the two ends of the rod are not coated in the predetermined region. In an electroplating plant, masks and racks must be available in sufficient number for all the current rod lengths, diameters and areas of plating. Since the racks also serve to feed the current conducted by the bath to the rods, they have to be made of a conductive metal. Prior to galvanizing, the metal has to be protected by layers of plastic.

The document DE-AS 11 03 103 describes a device for galvanic chromium plating of the outer surface of disk valve stems. In order to permit partial galvanizing of the stems, said stems are accommodated in a centric manner in tubular anodes and are fastened by the upper side in a stepped metallic core. Current is fed via the metallic core, the metallic core being separated from the electrolytic cell by an insulating body. The metallic core and the insulating body constitute the boundary for the galvanic coating at the upper end of the stem. The lower end is protected against undesired galvanizing by a protective lacquer.

The disadvantage of this embodiment is that each body to be galvanized has to be attached individually and that the protective lacquer has to be applied with dimensional accuracy to one end of the body. To remove the protective lacquer once galvanizing has been completed is also complicated.

DE 197 22 983 A1 indicates a method and a device permitting to partially electrochemically process, in particular to electrochemically process rods of various dimension in dip plants.

For each rod, defined adjustable masks with sealing means in the form of terminal collars are employed at either end of the rod to delimit the surfaces to be treated. In a charging station, several electrically conductive grippers, which are attached to the flight bar, simultaneously grasp one rod each on one side. By immersing the rods into the electrolytic processing station, each rod enters an individual cell constituted by the rod and one stationary tubular electrode. Either of the electrolytically effective upper and lower end of the electrode is defined by a tubular, axially adjustable mask. Each end of the mask is terminated by a collar. By immersing the flight bar, the rod first passes through the upper collar, enters the electrode and eventually traverses the lower collar. By displacing the upper and lower mask independently from one another parallel to the axis of the rod, the two plating boundaries, or the surface on the rod which is to be plated, are uniformly adjusted for each flight bar or for each row of rods on the flight bar. This method overcomes the drawbacks of the prior art rack technique, in which for each rod dimension a special mask in the form of caps or holders is needed. In practical operation however, the objects to be processed are often hanging crookedly since metal has deposited on the tongs holders or since the holders are damaged. When the no longer centrically hanging objects to be processed are being entered into the masks, the collars laterally gape and may be damaged by sharp edges. As a result of the damaged collars, accurately dimensioned galvanizing is no longer possible. What makes it even more difficult is that damages on the collars only become noticeable once the galvanized articles have exited the plant, since the collars, when immersed in the electrolyte, cannot be seen from the surface of the bath. The articles processed under these conditions are unserviceable.

The basic problem of the present invention is therefore to avoid the drawbacks of the methods and devices of the art for shielding rods during the galvanizing process and in particular to keep the amount of work required for shielding such areas on the rods that are not to be galvanized as small as possible. Moreover, the method is intended to work perfectly, even under manufacturing conditions.

The solution of this problem is given by a self-centering device according to the instant invention.

The device according to the invention serves for the partial electrochemical processing of rod-shaped objects in dip plants. The device comprises a. at least one plating tank, b. in the at least one plating tank, tubular electrodes and at least one tubular membrane carrier in which the objects to be processed may at least partially be entered, and c. membrane holders arranged within the at least one membrane carrier.

The tubular membrane carriers are preferably made of a chemically stable material which is electrically nonconductive on its surface at least.

According to the dimensions of the objects to be processed, the device is provided with axially adjustable, electrically nonconductive shielding facilities. At least one shielding facility is provided for each rod. A shielding facility may be provided for example at the lower end of the rod within the plating tank in order to prevent this portion of the rod from being electrochemically treated. In this case, the upper portion of the rod could remain untreated by not submerging it into the solution. Shielding facilities may also be provided at either end of the rod, though.

The shielding facilities comprise at least one cage (34) within the tubular membrane carrier. The cages are arranged in such a manner that the objects to be processed are capable of being pushed through them and are each formed by at least one cage cover and at least one cage bottom, respectively. A membrane holder holding a membrane is carried in a radially movable fashion between the cage cover and the cage bottom in each cage. At least one inner centering spring for guiding the objects to be processed and at least one outer centering spring for centering the membrane holder and the membrane in the cage are provided on each membrane holder. The membranes are preferably made of a chemically stable, extensible and electrically nonconductive material.

The cages are arranged on that side of the shielding facility which is facing the center of the rod.

The outer centering springs are preferably rod-shaped and designed as leaf springs and are tangentially fastened to the outer surfaces of the membrane holder. Their function is to center the membrane holder and the membrane in the cage and they oppose a radial pressure exerted by an off-center rod onto the membrane and the membrane holder. The force of the outer centering springs is adapted to the tensile property of the elastic membranes. It should be selected to be so large as to prevent the membranes from gaping as a result of lateral pressure applied by the objects to be processed or, in the extreme, from tearing, thus destroying the shielding effect at this place.

The force of the inner centering springs should however be selected to be smaller than the spring force of the holding tongs for the rods in order not to jeopardize the secure fastening of the rods on and their electrical contact with the holding tongs. If the lateral pressure of the rods which are received by the inner springs of the membrane holder is too high, i.e., the centering effect is no longer sufficient to center the rods, the membranes are pushed off-center while the rods are entering the shielding facility, thus preventing the membranes from being damaged. In so doing, the accurate shielding of the field lines is nevertheless made possible. By contrast, in the shielding membranes of the art which are rigidly fastened to the shielding facility, the membranes made of elastic material gape upon lateral pressure exerted by the rods so that the shielding action is impaired at this place.

Within the lower membrane carrier and underneath the membrane, there are mounted, acting as inner centering springs, either several wings of centering springs which are tapering toward the center and are resiliently attached to the membrane holder or at least three resilient centrically arranged spring rods that constitute a guide, said inner centering springs having a centering effect on the rods by gripping the rods threaded through the membrane, thus acting as a centering guide. More specifically, the spring bars may be given an elongated shape and may, starting from a plane formed by the membrane holder and running slantways, form together with the free ends, an opening which is aligned with the center of the membrane holder, and through which the rods can be passed.

At least two non-rotatable spring bars attached at one end to the membrane holder and having mating non-rotatable centering guides attached to the free end of the membrane holder may be utilized as inner centering springs within the lower membrane carrier. Said spring bars are oriented in such a way that a rod, which may be threaded through the membrane held by the membrane holder, may be gripped by the spring bars. The guides provided for the rods are each prismatic and essentially parallel to the spring bars.

The inner centering springs accommodated within the upper membrane carrier may specifically be of an elongated shape and may, standing essentially upright on a plane constituted by the membrane holder, form, together with the free ends which are bent at an angle of at least 45°0, preferably of at least 90° and in particular of at least 180°, an opening which is aligned with the center of the membrane holder and through which the rods can be passed.

Upon exiting the rods out of the shielding device of the invention, the outer springs on the membrane holders ensure that the membranes center themselves again for the next batch of rods entering the device, i.e., that they return to their original position.

In order to adjust the device for the processing of various rod lengths or of various geometrical shapes of the rod areas to be plated and not to be plated, height adjusting facilities are provided by means of which the membrane carriers with the membrane holders and the membranes may be moved in vertical direction.

The device permits to conduct a method for partially electrochemically processing the rods in dip plants involving the following stages:

a. Grasping the essentially vertically oriented rods by means of appropriate holding elements;

b. Immersing the rods into a plating tank and into a membrane holder arranged within at least one membrane carrier, the plating tank being provided with tubular electrodes and with at least tubular one membrane carrier into which the rods may be at least partially entered;

c. Conveying the objects to be plated through one central opening each in at least one membrane held by the membrane holders.

In the process of passing through the at least one membrane, such rods which are not vertically arranged and the central openings in the membranes are automatically aligned.

The invention will be described in more detail with the help of the examples illustrated in the Figures listed below.

DETAILED DESCRIPTION OF DRAWINGS

Figure 1A:
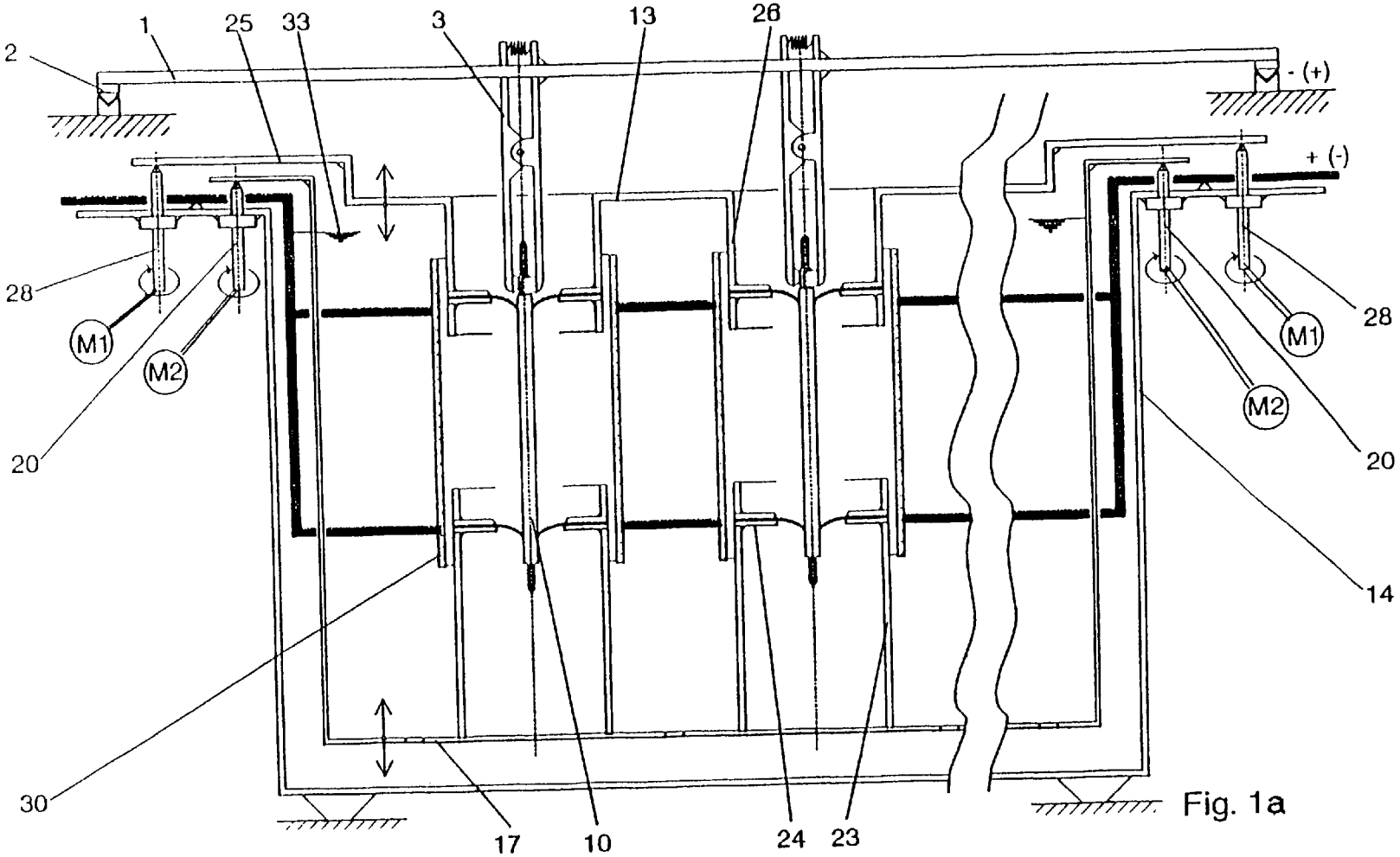
FIG. 1*a* shows in schematic form a section through a charging station of the art.
Figure 1B:
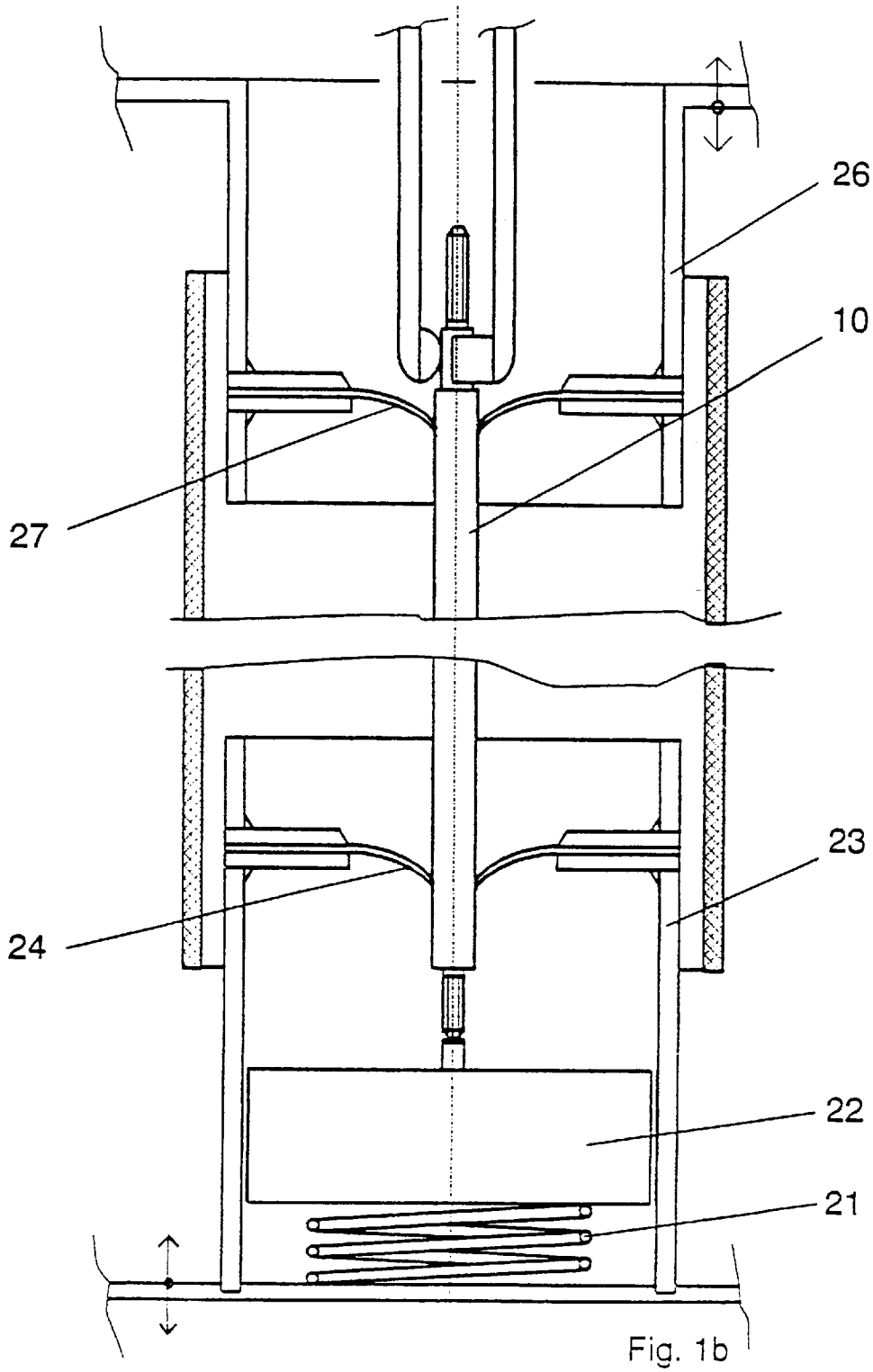
FIG. 1*b* shows in schematic form a section through a rigid mask in a charging station of the art.

FIG. 1*a* shows a vertical section through a plating tank with several conventional electrolytic individual cells for the chromium plating of rods. FIG. 1*b* shows a partial vertical section of a single conventional electrolytic individual cell inside the plating tank of FIG. 1*a*.

A plating tank 14 is filled up to the rim 33 with an electrolyte. Tubular electrodes 30 which are connected in an electric conductive way to a source of direct current (not shown) are mounted in the plating tank. Furthermore, two diaphragm carriers 17 and 25 which are adjustable in vertical direction independently from one another are provided in and at the plating tank 14. On the flight bar 1, which is kept in the right position in the bath by way of the support for the flight bar 2, there are arranged holding tongs 3 which make electrical contact with the rods 10 and hold them fast. On lowering the flight bar 1 into the tubular electrodes 30, the rods 10 first pierce the collars 27 in the upper membrane carrier 26 which are rigidly attached to the vertically adjustable diaphragm carrier 25 (FIG. 1*b*). On further lowering the flight bar 1, the rods 10 also pierce the collar 24 of the lower membrane carrier 23 (FIG. 1*b*), which is attached to the lower diaphragm carrier 17. The lower diaphragm carrier 17 with the membrane carrier 25 and the collars 24 (FIG. 1*b*) as well as the upper diaphragm carrier 23 with the membrane carrier 26 and the collars 27 are adjustable in height thanks to the adjusting facilities 20 and 28 in conformity with the requirements of the rods 10. In order to further reduce the current density in the lower area of the rods, conductive auxiliary cathodes 22 may be provided as shown in FIG. 1*b*, said auxiliary cathodes being urged against the immersed objects 10 by way of springs 21, thus considerably increasing the cathodic acting surface or reducing the cathodic current density so much that no deposit can henceforth take place in the lower shielded area In this way, rods 10 with various dimensions and varying requirements for the position of the partial plating/processing can be processed in the tank.

In the following, reference will be made to the embodiments in accordance with the invention. As far as specific elements of the device are not illustrated in the FIGS. 2 through 4, like elements will instead be referred to with the corresponding reference numerals in the FIGS. 1*a* and 1*b*. So far, the FIGS. 1*a* and 1*b* also illustrate inventive features of the device.

Figure 2:
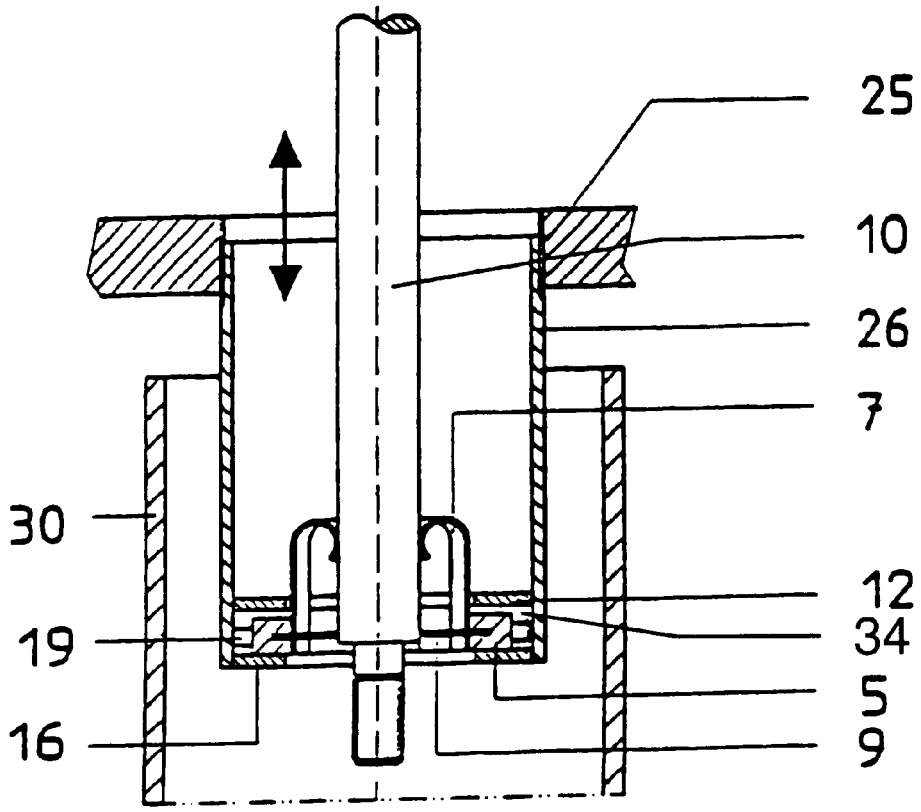
FIG. 2 shows in schematic form a section through an upper membrane carrier of the invention.

In FIG. 2, the upper membrane carrier 26 according to the invention is illustrated in a vertical sectional drawing as a cutout of an individual galvanizing cell inside the plating tank 14 which is not illustrated herein (see FIG. 1*a*). The tubular membrane carrier 26 is attached to the upper diaphragm carrier 25, which is adjusted by way of a height adjusting facility 28 not shown (see FIG. 1*a*) to the position suited for the rods to be produced.

The adjustment of the diaphragm carrier 25 concurrently causes the electric nonconductive tube of the membrane carrier 26 to penetrate the insoluble electrode 30 which is shown in a cutout, thus shielding that length of the electrode, which is not needed. On immersing the rods 10 into the plating tank 14, the diaphragm carrier 25 may advantageously be placed in the upper position.

The diaphragm carrier 25 and all of the elements that are submerged into the plating tank are made of a chemically stable material. PVC, PVDF, PTFE for example are available as electric nonconductive materials. For electric conductive materials, titanium or lead may be used.

When the flight bars 1, which is not illustrated herein, is immersed, the rod 10 is first entered into the area of the inner centering springs 7 which apply a centering pressure to the rod 10 and align it, when it is not hanging centrically downward If the pressure of the spring is not strong enough to align the rod 10, the membrane holder 5, which is held by the outer centering springs 19, is shifted in horizontal direction, so to adapt to the position of the rod in order to prevent the delicate membrane 9 from being damaged or expanded. In order to make certain of the functioning of the membrane holder 5, the cage cover 12 and the cage bottom 16 are accommodated on the tubular membrane carrier 26 in such a manner that the membrane holder 5 is free to move in horizontal (radial) direction, but is sufficiently held fast in vertical direction. After the rod 10 has been lowered to its lowermost position, the upper diaphragm carrier 25 may be brought downward into the shielding position prescribed by the design of the rod. In a preferred embodiment, the shielding membrane 9, which sits close to the rod 10, in the process arches from the inside in a conical shape upward. This reduces the "bone" effect (the formation of a thickened galvanic deposit) at the ends of the rod 10.

Upon completion of the treatment, the rod 10 is vertically exited upward out of the galvanizing cell. As soon as the rod 10 has exited the membrane 9, the membrane holder 5 is centered again by way of the outer springs 19 in the center of the membrane carrier 26.

Figure 3:
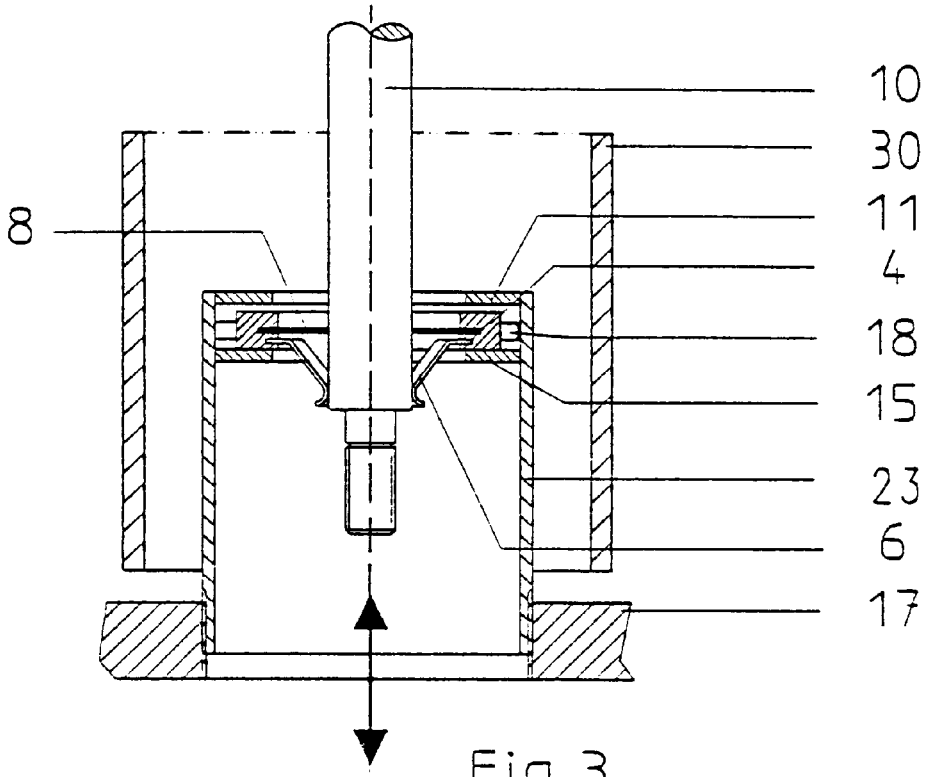
FIG. 3 shows in schematic form a section through a lower membrane carrier of the invention.

In FIG. 3, the lower membrane carrier 23 according to the invention, together with a small cutout of the diaphragm carrier 17, is shown in a vertical section through an individual galvanizing cell inside the not shown plating tank 14 (see FIG. 1*a*). The tubular membrane carrier 23 is attached to the lower diaphragm carrier 17 and may be brought by way of the height adjusting facility 20 which is not illustrated herein (see FIG. 1*a*) into the lower position suited for the rods 10 to be produced. The height of the membrane carrier 23 is preferably adjusted before the not shown flight bar 1 is immersed.

In principle, the structure of the lower shielding facility is equal to the upper shielding facility of FIG. 2. Here too, the membrane holder 4 with the outer centering springs 18, the cage cover 11, the cage bottom 15 as well as the inner centering springs 6 are to be found. The inner centering springs 6 however are arranged underneath the membrane 8 in order to prevent them from having a disturbing influence upon the concentration of the field lines in the galvanizing area of the rod 10. It is important in this case that the distance chosen between the centering spring 6 and the membrane 8 is not too great in order to prevent the membrane 8 from being damaged by the not yet centered rod 10 or the right position of the membrane 8 from being achieved. After the rod 10 has passed through the upper shielding facility while being submerged into the cell, it impinges first on the membrane 8 as it is further immersed, is then passed through said membrane, is moved against the inner centering spring 6 and is centered if necessary (when the centering action of the upper shielding facility is not sufficient). If the pressure upon the spring 6 is too great, the membrane holder 4 is again horizontally (radially) shifted together with the membrane 8 against the spring force of the outer centering springs 18 in order to prevent the membrane 8 from gaping at the side which is not compressed by the rod 10 or from being damaged. In this way, it is guaranteed that the end of the rod is shielded with accuracy at its border. In just the same way as with the upper shielding facility, the outer centering springs 18 see to it that, after the rods 10 have exited the lower shielding facility, the membrane holder 4 returns to its original position, i.e., that it centers itself anew.

Depending upon the requirements of the rods 10, an upper diaphragming device only, a lower diaphragming device only, or both (upper and lower) can be used. A combination of the shielding facilities top/bottom is likewise possible in accordance with the invention and the state of the art.

Figure 4A:
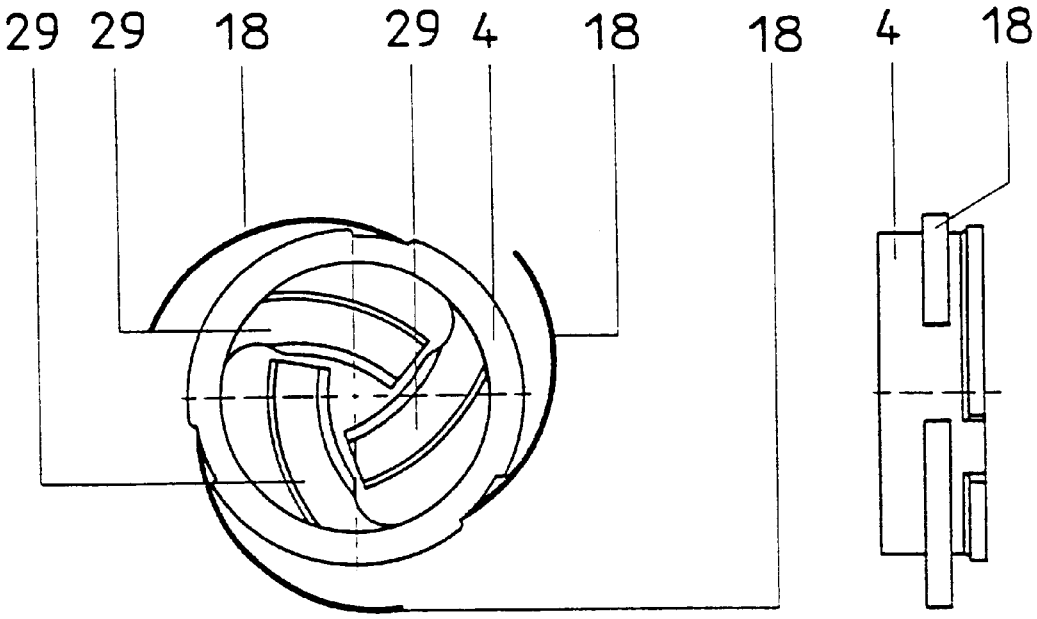
FIG. 4*a* shows in schematic form an embodiment of a lower membrane holder.

FIG. 4*a* shows a top view and a side view of a preferred embodiment of a lower membrane holder 4. The outer bar-shaped centering springs 18 are tangentially accommodated at the outer circumference of the cylindrical membrane holder 4. The inner centering springs 29 are wing-shaped and are staggered or inclined toward the center of the membrane holder 4, so that three conically running surfaces are created inside, against which the rod 10 that is not hanging centrically (see FIG. 3) is pressed when being entered into the facility. On further lowering the rod 10, the wing-shaped centering springs 29 flex downward and outward. This specific embodiment has the advantage that, on account of the reduced demands on the properties of the spring, abrasion resistant plastics may be used as a material with ideal shielding properties for the inner centering springs 29.

Figure 4B:
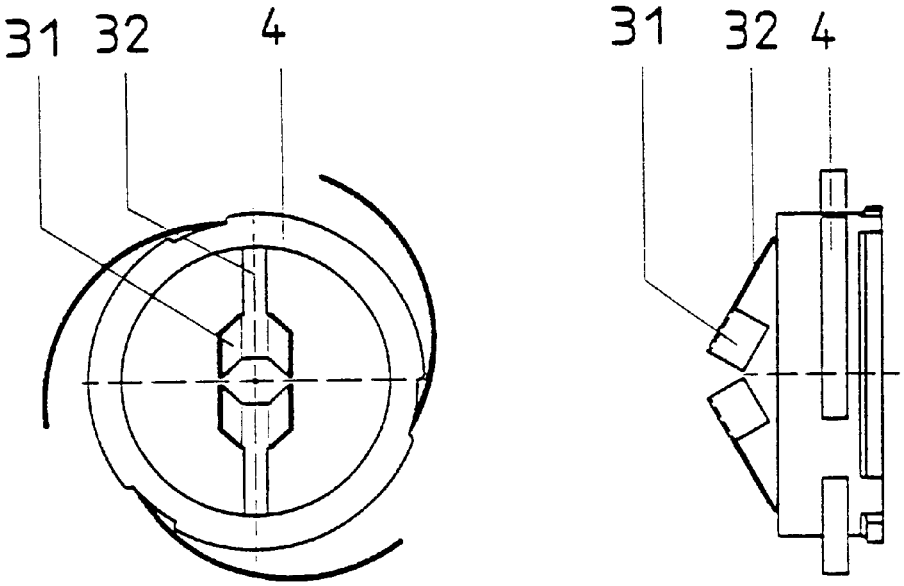
FIG. 4*b* shows in schematic form another embodiment of a lower membrane holder.

FIG. 4*b* again shows a membrane holder 4. As compared with the membrane holder 4 of FIG. 4*a*, the inner centering springs are provided in another form. Here, the centering springs consist of one spring bar 32 each, said spring bar being non-rotatably attached to the outer side of the membrane holder 4. A prismatic guide 31 is accommodated at the inner side of the spring bar 32, said guide being secured against rotation as well. The mounting direction of the spring bar 32 points diagonally downward starting from the membrane holder. Both springs 32, in conjunction with the prismatic guides 31, bring about a good centering of the rods 10 (see FIG. 3).

The inner centering springs 29, 32 of the FIGS. 4*a* and 4*b* are also suited for use on the upper membrane holders 5. In this case though, the centering springs 29, 32 must be arranged above membrane holder 5 as shown in FIG. 2.

LISTING OF REFERENCE NUMERALS

1 flight bar
2 support for the flight bar
3 holding tongs
4 membrane holder bottom
5 membrane holder top
6 inner centering spring bottom
7 inner centering spring top
8 shielding membrane bottom
9 shielding membrane top
10 rod (objects)
11 cage cover in lower shielding facility
12 cage cover in upper shielding facility
13 plastic plate
14 plating tank
15 cage bottom in lower shielding facility
16 cage bottom in upper shielding facility
17 lower diaphragm carrier
18 outer centering spring for shielding membrane bottom
19 outer centering spring for shielding membrane top
20 height adjusting facility for shielding facility bottom
21 pressure spring
22 auxiliary cathode
23 tubular membrane carrier bottom
24 collar bottom
25 upper diaphragm carrier
26 tubular membrane carrier top
27 collar top
28 height adjusting facility for shielding facility top
29 wing-shaped centering spring
30 electrode
31 prismatic guide
32 spring bar
33 rim

What is claimed is:

1. Device for the partial electrochemical treatment of rod-shaped objects in dip plants, comprising a. at least one plating tank (14), b. in the at least one plating tank (14), tubular electrodes (30) and at least one tubular membrane carrier (23, 26) in which objects to be processed may at least partially be entered, and c. membrane holders (4, 5) arranged within the at least one tubular membrane carrier (23, 26) wherein at least one cage (34) is provided within the at least one tubular membrane carrier (23, 26), said cage being arranged in such a manner that the objects (10) to be processed are capable of being pushed there through and each said cage being formed by at least one cage cover (11, 12) and at least one cage bottom (15, 16), a membrane holder (4, 5) holding a membrane (8, 9) being carried in a radially movable fashion between the cage cover (11, 12) and the cage bottom (15, 16) in each cage and wherein at least one inner centering spring (6, 7, 29, 32) for guiding the objects (10) to be processed and at least one outer centering spring (18, 19) for centering the membrane holder (4, 5) with the membrane (8, 9) are provided in the cage.

2. Device according to claim 1, wherein at least three inner centering springs (6, 7) are attached to a membrane holder (4, 5) and are oriented in such a manner that objects (10) that may be pushed through the membrane (8, 9), which is held by the membrane holder (4, 5), may be gripped by the springs (6, 7) and wherein the springs (6, 7) constitute a centering guide for the objects (10).

3. Device according to claim 1, wherein at least two spring bars (32) are provided as inner centering springs, said spring bars being non-rotatably attached by their one end to the membrane holder (4, 5) and being oriented in such a manner that objects (10) that may be pushed through the membrane (8, 9), which is held by the membrane holder (4, 5), may be gripped by the spring bars (32), and prismatic guides (31) for the objects (10), which are running essentially parallel to the spring bars (32), being non-rotatably attached to their free ends thus allowing the objects (10) to be centered by said guides.

4. Device according to claim 1, wherein wing-shaped springs (29) are provided as inner centering springs, said wing-shaped springs being attached by their one end to the membrane holder (4, 5) and being oriented in such a manner that objects (10) that may be pushed through the membrane (8, 9), which is held by the membrane holder (4, 5), may be gripped by the springs (29), the springs (29) constituting together a centering guide for the objects (10).

5. Device according to claim 4, wherein the inner centering springs (6, 7) have an elongated shape and form, together with the free ends, starting from a plane formed by the membrane holder (4, 5) and running slantways, an opening which is aligned with the center of the membrane holder (4, 5), and through which the objects can be passed.

6. Device according to claim 4, wherein the inner centering springs (6, 7) have an elongated shape and, standing essentially upright on a plane constituted by the membrane holder (4, 5), form together with the free ends which are bent at an angle of at least 45°, an opening which is aligned with the center of the membrane holder (4, 5) and through which the objects can be passed.

7. Device according to one of the previous claims 1–6, wherein the leaf springs (18, 19) acting as outer centering springs (18, 19) are tangentially attached to the membrane holder (4, 5).

8. Device according to one of the previous claims 1–6, wherein the tubular membrane carriers (23, 26) are made of a chemically stable and at least on its surface electric nonconductive material.

9. Device according to one of the previous claims 1–6, wherein the membranes (8, 9) are made of a chemically stable, expandable and electric nonconductive material.

10. Device according to one of the previous claims 1–6, wherein the membrane carriers (23, 26) together with the membrane holders (4, 5) and the membranes (8, 9) are movable in vertical direction by way of height adjusting facilities (20, 28).

11. Process for partially electrochemically processing rod-shaped objects in dip plants comprising the following steps:

a. Grasping the essentially vertically oriented objects by means of appropriate holding elements;

b. Immersing the objects into a plating tank and into a membrane holder arranged within at least one membrane carrier, the plating tank comprising with tubular electrodes and at least one membrane carrier into which the objects may be at least partially entered;

c. Conveying the objects to be plated through one central opening each in at least one membrane held by the membrane holders;

wherein, in the process of passing through the at least one membrane (8, 9), such objects which are not vertically arranged and the central openings are automatically aligned.

* * * * *

UNITED STATES PATENT AND TRADEMARK OFFICE

CERTIFICATE OF CORRECTION

PATENT NO. : 6,508,926 B1
DATED : January 21, 2003
INVENTOR(S) : Johann Falkner et al.

It is certified that error appears in the above-identified patent and that said Letters Patent is hereby corrected as shown below:

Column 1,
Line 6, delete the word “galvaniz”

Column 4,
Line 12, after “45º”, delete the “0”

Signed and Sealed this

Twentieth Day of May, 2003

JAMES E. ROGAN
*Director of the United States Patent and Trademark Office*